US006089896A

United States Patent [19]

Kosmala

[11] Patent Number: 6,089,896

[45] Date of Patent: Jul. 18, 2000

[54] CONNECTOR HOLDOWN

[75] Inventor: Michael Lawrence Kosmala, Aliso Viejo, Calif.

[73] Assignee: ITT Manufacturing Enterprises, Inc., Wilmington, Del.

[21] Appl. No.: 09/206,044

[22] Filed: Dec. 4, 1998

[51] Int. Cl.[7] ..... H01R 13/62

[52] U.S. Cl. ..... 439/329; 439/354

[58] Field of Search ..... 439/327, 329, 439/354, 374, 357, 358

[56] References Cited

U.S. PATENT DOCUMENTS

| | | | |
|---|---|---|---|
| 4,172,626 | 10/1979 | Olsson . | |
| 5,173,058 | 12/1992 | Broeksteeg et al. | 439/267 |
| 5,194,017 | 3/1993 | Consoli | 439/492 |
| 5,234,357 | 8/1993 | Yamaguchi | 439/354 |
| 5,269,694 | 12/1993 | Kachlic et al. | 439/79 |
| 5,277,627 | 1/1994 | Matsuzaki | 439/677 |
| 5,354,214 | 10/1994 | Aso et al. | 439/492 |
| 5,474,468 | 12/1995 | Chishima et al. | 439/495 |
| 5,533,908 | 7/1996 | Henry et al. | 439/329 |

*Primary Examiner*—Lincoln Donovan
*Assistant Examiner*—Javaid Nasri
*Attorney, Agent, or Firm*—Thomas L. Peterson

[57] ABSTRACT

A receptacle (12) is provided for mounting on a board (14) and for receiving a plug (16), where the receptacle is strengthened to prevent the plug from tilting about a lateral (L) axis when a cable (18) extending from the plug is pulled up or down. The receptacle has laterally opposite sides that each forms at least the upper wall (44) of a key-receiving slot (24, 26), for receiving keys (20, 22) at laterally opposite sides of the plug, to fix the vertical position of the plug and prevent the plug from tilting. The receptacle includes a body (80) of molded polymer material, and also includes first and second pairs of clips (60,62) that are each formed of an engineering metal. Each clip has a clip part (64) that forms a portion of the upper slot wall that prevents upward movement and tilting of the plug, and each clip has downwardly projecting pins (70, 72) that are received in holes (77, 78) in the board and are soldered thereto. The first and second clips at each side of the receptacle, are longitudinally (M) spaced along the longitudinal length of the slot, to prevent tilt of the plug.

8 Claims, 4 Drawing Sheets

CONNECTOR HOLDOWN

BACKGROUND OF THE INVENTION

One type of connector system that is small enough to be used in portable cellular telephones, is described in U.S. Pat. No. 5,807,126. That system includes a receptacle that is mounted on a circuit board, with the circuit board having a row of traces. The receptacle has opposite sides that form the upper walls of slots, to position the connector and hold it close to the circuit board. A wall of the receptacle pushes down contacts of the plug against the circuit board traces. One problem encountered with this type of connector results when the cord extending from the plug is pulled up or down. An upward pull on the cord not only tends to lift the mating end of the plug, but also tends to tilt the front end of the plug about a lateral access. This can result in the plug contacts losing engagement with the circuit board traces, and also can result in breakage of the upper slot walls of the receptacle. A downward pull on the cable extending from the plug, can result in opposite tilt of the front end of the plug, which also can cause breakage of the receptacle slot upper wall. Since the receptacle includes a molded plastic body, the receptacle can be strengthened without increasing its size, by using a very high strength engineering plastic, especially one that is filled with glass fibers. However, the strength and rigidity still may not be high enough to avoid contact interruption or breakage in normal use where a pull on the cord of two to five pounds in different directions may be applied. Also, glass fiber reinforced plastics have strengths and rigidities that are not highly consistent. If a receptacle could be further strengthened to resist upward deflection of its slot upper walls, without changing the size of the receptacle, this would result in a small connection system of greater reliability in normal use.

SUMMARY OF THE INVENTION

In accordance with one embodiment of the present invention, a connection system is provided that includes a small receptacle for mounting on a board and for receiving a plug, where the receptacle is strengthened to resist upward movement and tilting of the plug, in a simple manner that avoids significantly increasing the size of the receptacle. The receptacle has laterally opposite sides that each forms at least the upper wall of a key-receiving slot, for receiving a key of the plug under the upper slot wall. The receptacle includes a body of molded polymer material, and a clip at each side that is formed of engineering metal. Each clip has a clip part that forms a portion of the upper slot wall, and each clip has a pin that projects into a hole in the board. The engineering metal has a strength and stiffness that is about an order of magnitude greater than the material of the body. The clip part at the slot wall is fixed to the board at a location close to the location where the clip forms an upper wall of the slot. As a result, upward forces applied to the upper slot wall are resisted largely by the clip. This allows the small receptacle to resist upward movement or tilt of the plug, which otherwise could cause plug contacts to loose engagement with circuit board traces and/or cause breakage of the upper slot walls.

The clip preferably has a pair of pins that project into a pair of holes in the circuit board. The pins are slightly laterally spaced from the upper wall, and the provision of two laterally-spaced pins allows the clip to resist upward tilt or prying. Preferably, a pair of clips are placed along each upper slot wall of the receptacle, to prevent both the rear and front ends of the slot upper walls from deflecting upward.

The novel features of the invention are set forth with particularity in the appended claims. The invention will be best understood from the following description when read in conjunction with the accompanying drawings.

DESCRIPTION OF THE PREFERRED EMBODIMENT

Figure 1:
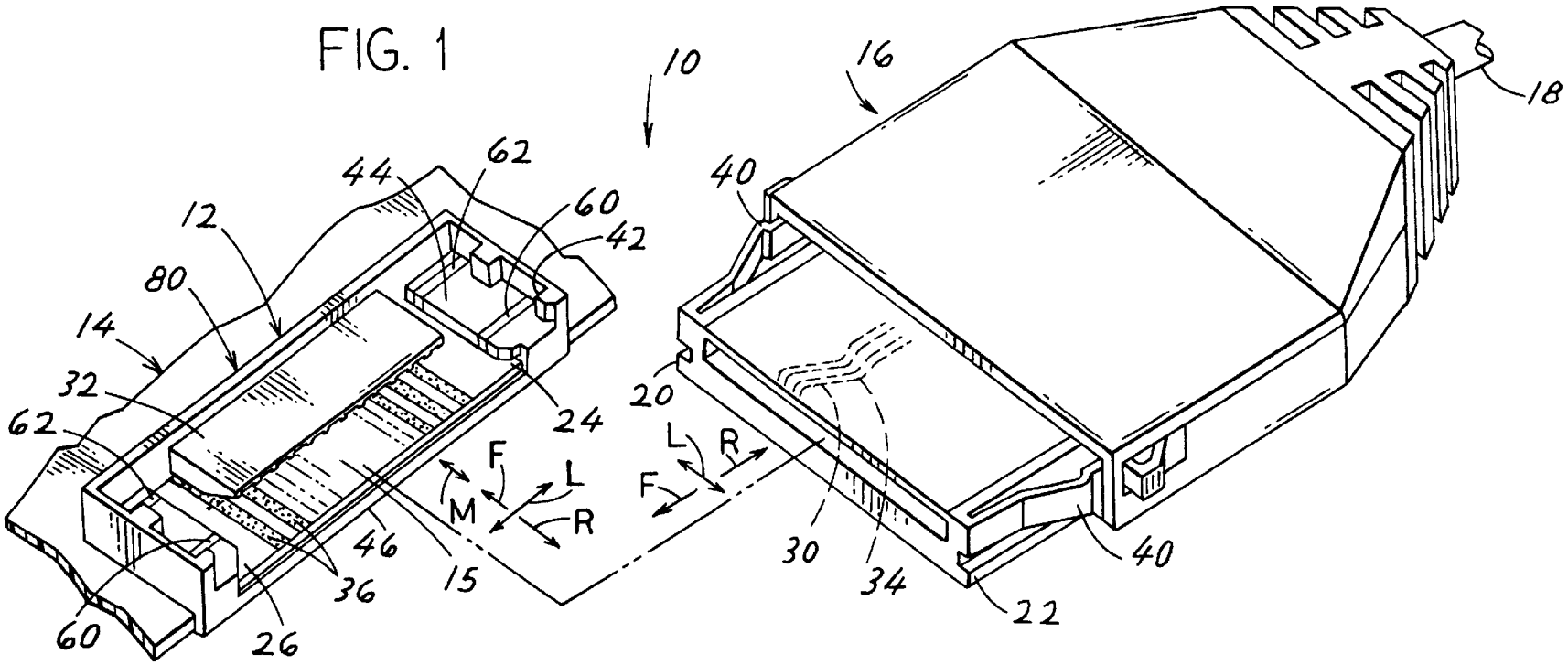
FIG. 1 is an exploded isometric view of a connection system of the present invention, showing the receptacle and a portion the circuit board on which the receptacle is mounted, and showing a plug that can be mated to the receptacle.

FIG. 1 illustrates a connector apparatus or system 10, which is suitable for use on a cellular telephone where very little space is available. The system includes a receptacle 12 for mounting on a board 14 or other supporting device that may be similar to a circuit board. The receptacle and board form a rearward-opening cavity 15. This system also includes a plug 16 with a cable 18 extending rearwardly R therefrom. The receptacle 12 and board 14 may be mounted on an electronic device that has limited space to accommodate the receptacle, with the receptacle being open in a rearward direction. Longitudinal directions are indicated by arrows M, while forward and rearward longitudinal directions are indicated by arrows F and R. The plug 16 is connected through the cable 18 to other electronic equipment such as a computer, an antenna, etc. The plug is mated to the receptacle by moving the plug in a forward direction F until keys 20, 22 at laterally L opposite sides of the plug are received in key-receiving slots 24, 26 at laterally opposite sides of the combination receptacle and board. As the plug becomes fully inserted, plug contacts 30 are downwardly deflected by a receptacle deflection wall 32, to cause plug contact parts 34 to move below a lower wall of the plug and engage a row of terminals 36 formed by traces on the board. As the plug becomes fully mated to the receptacle, a pair of latches 40 at either side of the plug move immediately forward of shoulders 42 on the receptacle to hold the plug in position.

Figure 11:
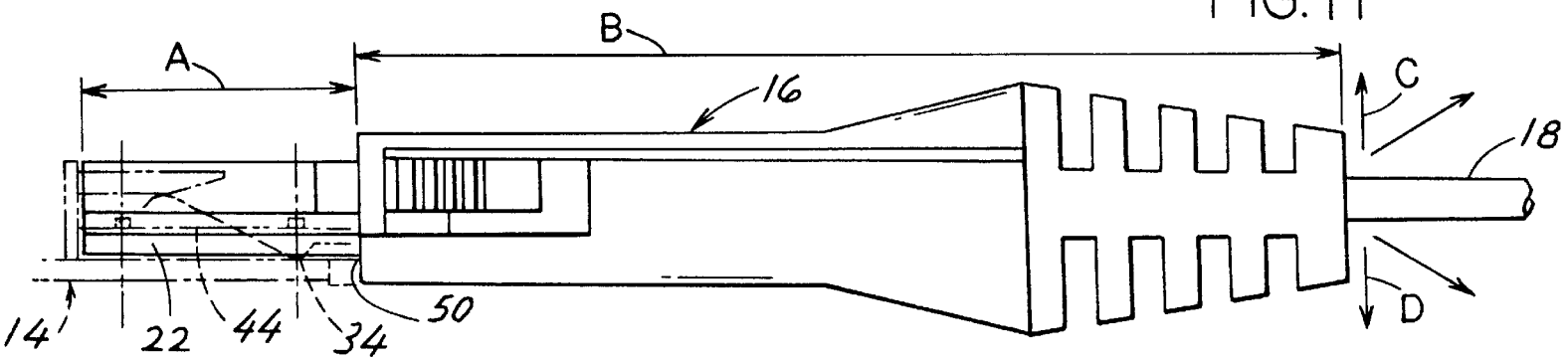
FIG. 11 is a side elevation view of the plug of FIG. 1, and showing in phantom lines, the receptacle and circuit board of FIG. 1.
Figure 10:
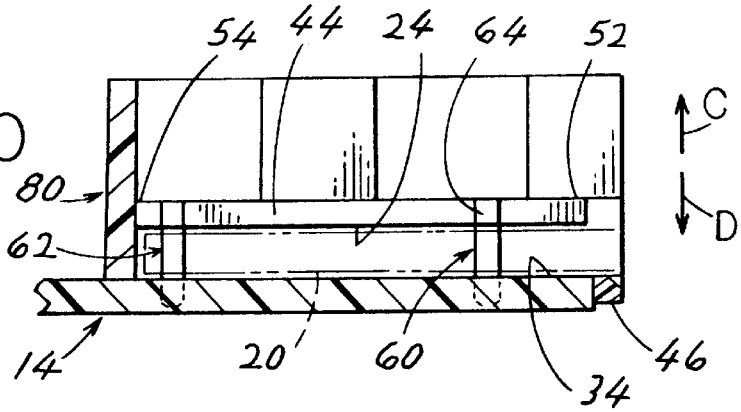
FIG. 10 is a view taken on line 10—10 of FIG. 7, and showing a fully installed key of the plug connector in phantom lines.

Each key-receiving slots such as 24 has an upper wall 44 that holds down a corresponding key 20. The bottom wall of the slot is formed largely by the board 14, although a front guard 46 on the receptacle can be considered to form a lower slot wall at the extreme rear end of the receptacle. In any case, the keys 20, 22 of the fully installed plug lie closely under the slot upper walls 44. FIG. 11 shows a key 22 which lies closely under a slot upper wall 44, with lower ends 34 of the contacts bearing against the upper face of the circuit board 14 to contact terminal traces thereat. FIG. 10 shows a key 20 trapped between the upper wall 44 of a slot 24 and a circuit board 14.

It can be seen from FIG. 11 that only a small length A of the plug lies in the receptacle, but there is a long distance B between the receptacle-receiving part and the cable 18. During installation and use of the plug and connector, up and down forces indicated at C and D are often applied to the cable. These forces tend to tilt the plug keys such as 22 about one or more laterally-extending axis such as 50. Referring again to FIG. 10, it can be seen that an upward force C applied rearward of the key 20 tends to upwardly bend the rear end 52 of the slot upper wall 44. Initially such upward bending of the upper wall rear end 52 can result in the contact lower parts 44 breaking engagement with the circuit board traces 34, and resulting in opening one or more of the connections. A much larger upward force C can result in breakage of the upper wall near its rear end 52. In a similar manner, a downward force D results in torque that tends to lift the front end 54 of the upper wall.

Figure 6:
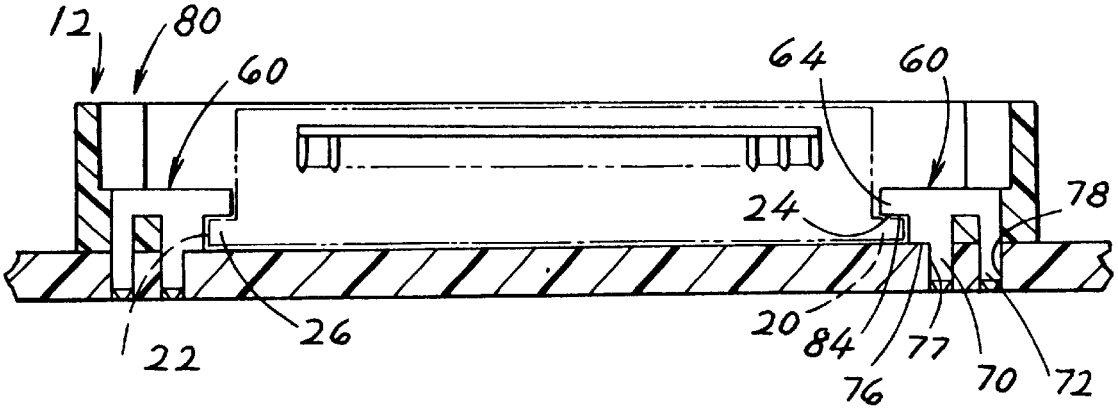
FIG. 6 is a sectional view taken on line 6—6 of FIG. 2.
Figure 7:
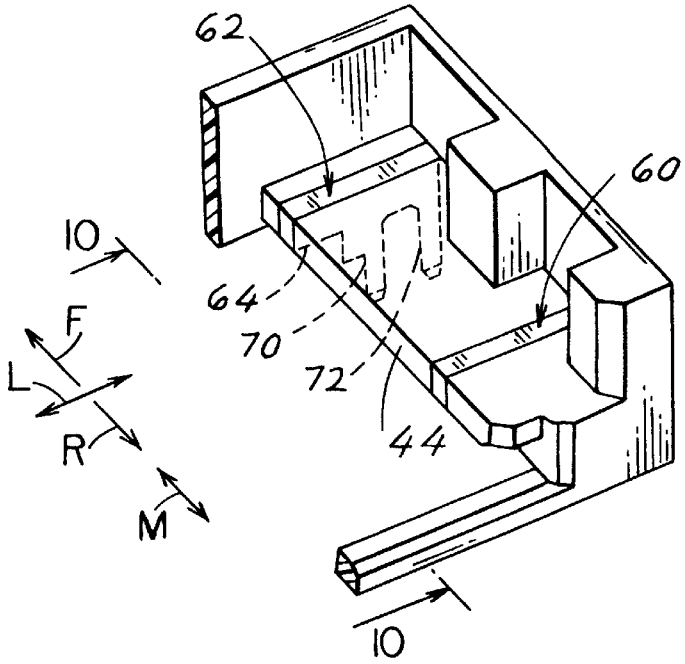
FIG. 7 is an isometric view of a portion of the receptacle of FIG. 1.
Figure 8:
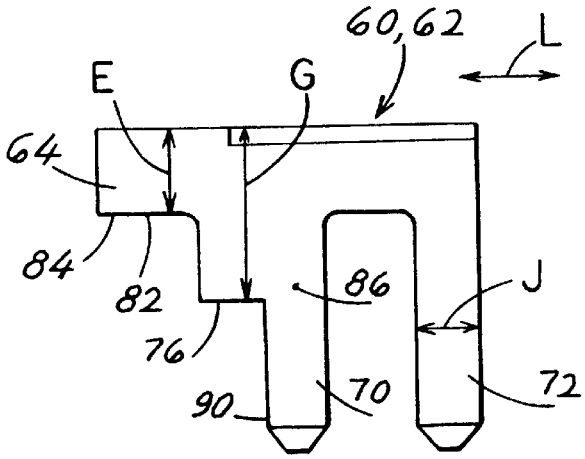
FIG. 8 is a front elevation view of one of the clips of the receptacle of FIG. 7.
Figure 9:
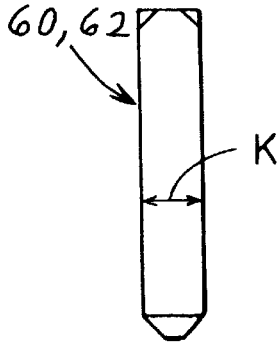
FIG. 9 is a side elevation view of the clip of FIG. 8.

In accordance with the present invention, application provides a pair of metal clips 60, 62 to strengthen the upper wall 44 of the key-receiving slot. As shown in FIG. 7 each clip such as 62 has a part 64 that forms part of the upper slot wall 44. Each key also has a pair of pins 70, 72 that project through holes in the board to anchor the clip to the board. FIG. 8 shows the shape of each clip 60, 62. Each clip has a board-abutting surface 76 that lies against the upper face of the board, with the pins 70, 72 projecting into holes of the board. FIG. 6 shows a clip 60 with its part 64 lying immediately over a plug key 20, with the board-abutting surface 76 abutting the board 14, and with the pins 70, 72 extending into holes 77, 78 in the board.

Each of the clips 60, 62 is formed of an engineering metal, that is, a metal with high strength and stiffness. About the lowest stiffness engineering metal is aluminum with a Young's modules of 71GPa or 10,000,000 psi, while a copper alloy has a Young's modules of 112GPa (16,000,000 psi). When the term metal is used herein, applicant is referring to an engineering metal, which is a metal having at least about the strength of pure aluminum. Engineering polymers, or plastics, which are used in molding parts, have a Young's modules of no more than about 2,000,000 psi when filled with glass fibers (higher price glass-filled polymers have a stiffness of up to 4,000,000 psi). Applicant forms the receptacle 12 with a body 80 of molded engineering polymer and inserts the clips 60, 62 into the molded body. The clips 60, 62 which are preferably of a copper alloy (preferably phosphor bronze) provide increased strength and rigidity at the slot upper walls 44. Upward forces applied to the upper slot wall parts 64 (FIG. 8) of the clips is directly transmitted through the pins 70, 72 of the clips to the circuit board. The pins, 70, 72 are preferably soldered to plated-through circuit board holes to fix them in place. Thus, when a key such as 20 (FIG. 10) is tilted upward (its rear end moves up) as a result of an upward force C applied to the cable, the upward tilting of the key 20 results in the rear end of the upper wall deflecting upward slightly, but with any further upward movement resisted by the upper slot wall part 64 of the clip 60. It would be possible to have the clip upper slot wall part 64 extend below the upper slot walls of the receptacle body, so all forces are applied directly to the clips, although applicant prefers to have the bottom of the clip slot walls 64 lie approximately flush with the lower surfaces of the slot walls formed by the molded receptacle body.

It would be possible to anchor each clip to the circuit board by the use of a single pin 70. However, the pin 70 is laterally L spaced from the middle 82 (FIG. 8) of the slot wall part lower surface portion 84 formed by the clip. As a result, a large upward force applied at 84, tends to tilt the pin 70 about a longitudinal axis such as 86, which can result in breakage of the lower end of the circuit board at the pin lower end 90. Applicant resists such breakage by providing the second pin 72 that resists tilting of the clip as a result of upward forces applied to the clip surface 84. The geometry of the clip (with two pins) is chosen for high stiffness in connection to the circuit board.

Figure 2:
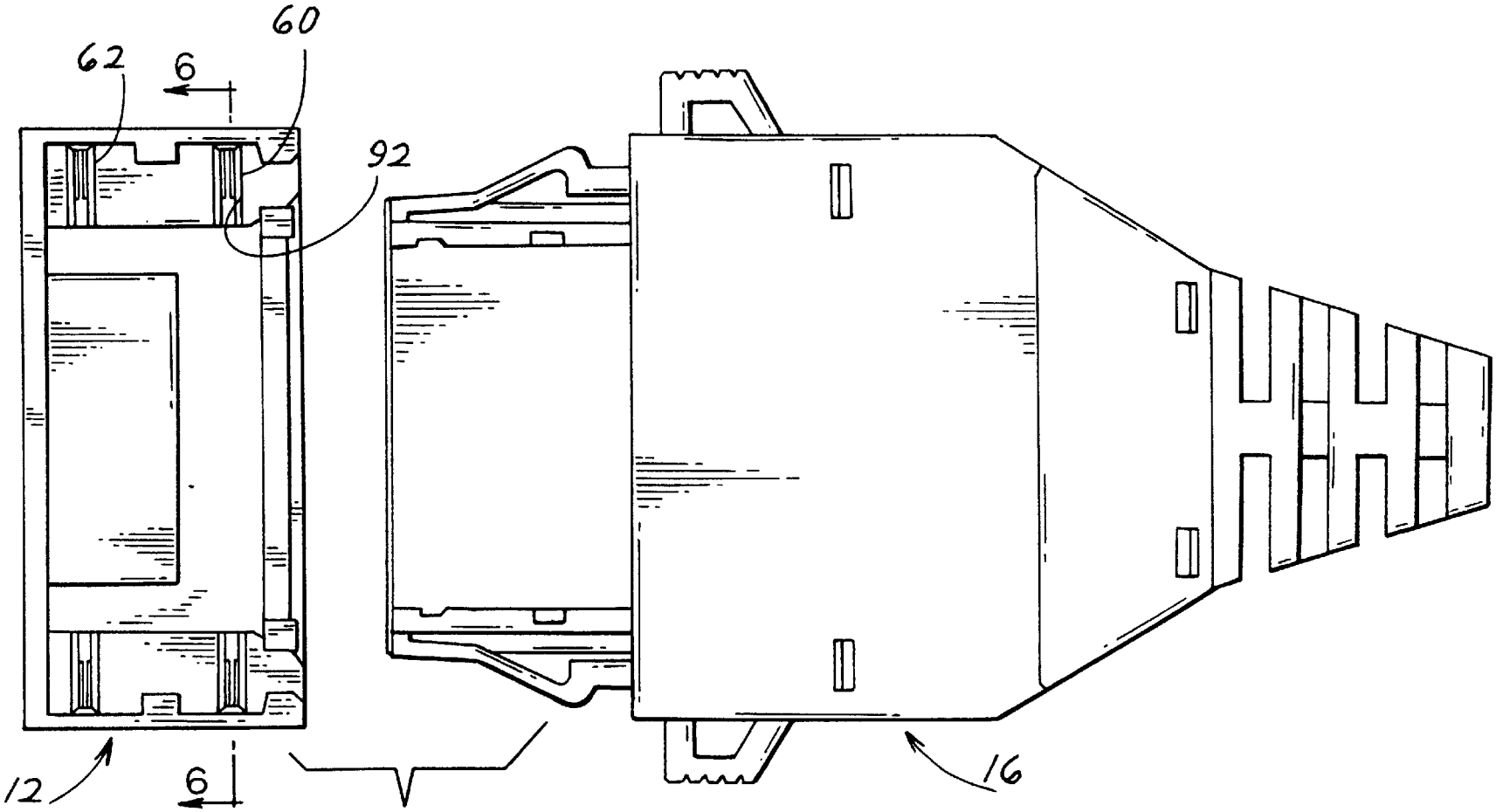
FIG. 2 is an exploded top view of the connection system of FIG. 1, but without the circuit board.
Figure 3:
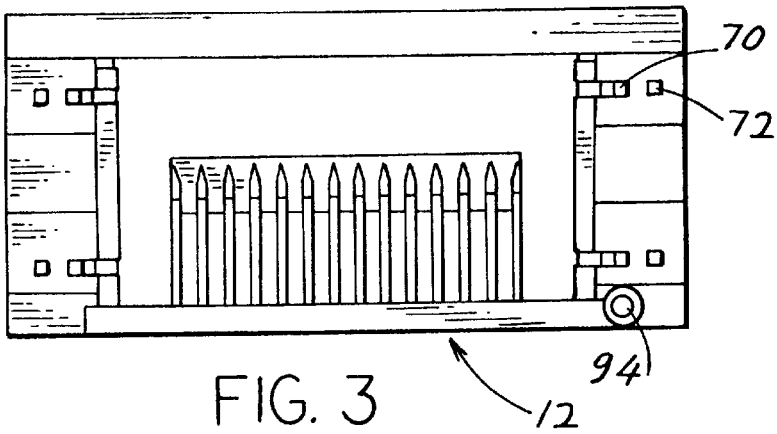
FIG. 3 is a bottom view of the receptacle of FIG. 1.
Figure 5:
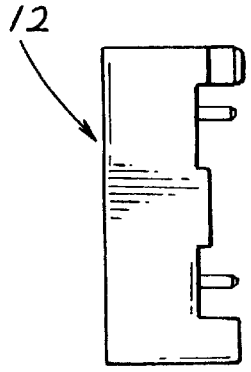
FIG. 5 is a side view of the receptacle of FIG. 3.
Figure 4:
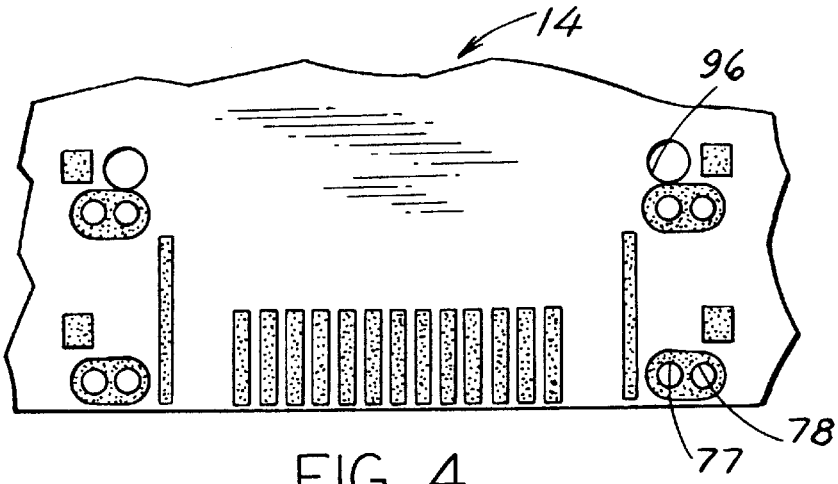
FIG. 4 is a plan view of a portion the circuit board of FIG. 1.

Applicant prefers to mold the receptacle body 80 of a high strength engineering plastic. The clips 60, 62 are preferably formed of a copper alloy sheet metal which has been formed to the shape illustrated (for easy soldering and plating). The receptacle body 80 is formed with slots 92 (FIG. 2) that are intended to receive the clips 60, 62 in a press fit. It may be noted that FIGS. 3 and 4 show that the body is formed with a downwardly-projecting post 94 which is intended to fit into a hole 96 in a circuit board, to directly anchor the receptacle body to the board.

In a connection system that applicant has designed and made, the receptacle had an overall lateral width of 25.72 mm and extended above the board by 4 mm. Each clip has an upper wall part 64 (FIG. 8) of a height E of 0.71 mm, a height G above the board of 1.47 mm, a pin width J of 0.51 mm, a clip thickness K of 0.61 mm and other dimensions relative to the above as illustrated in FIG. 8.

While terms such as "upper" and "lower" have been used to help describe the parts of the invention as illustrated, the apparatus can be used in any orientation with respect to the Earth.

Thus, the invention provides a receptacle for mounting on a board, which may be a circuit board or any other structure that can support a receptacle, for receiving a plug. The receptacle includes a body of a molded polymer material and clips of engineering metal. The receptacle forms at least the upper walls of key-receiving slots at its laterally opposite sides for receiving keys of the plug. The clips form at least part of each slot upper wall, with each clip having a downwardly-projecting part for mounting on the board independently of the receptacle body, the downwardly-projecting part preferably being pins that project into holes of the board. As a result, upward forces applied to the slot upper wall, may be resisted by the clips, with most of the forces applied to the clips being directly transmitted through the clips to the board. The receptacle preferably has a pair of clips at each laterally opposite side of the receptacle, the clips lying at forward and rearward portions of the slot upper wall. Each pin that projects into a board hole is laterally spaced from the clip part that forms an upper wall of the slot, and each clip preferably has two laterally spaced pins to resist upward prying and tilting of the clip.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Connection apparatus for mounting on a board and for receiving a plug that has opposite sides with keys, comprising:

a receptacle that includes a body of molded polymer material and a pair of first clips of metal, said body having a lower surface for substantially lying on said board and said receptacle having laterally opposite sides that each forms at least an upper wall of a key-receiving slot for receiving one of said keys under one of said slot upper walls;

each of said first clips lies at one of said laterally opposite sides of said receptacle and has a clip part forming a portion of the upper slot wall thereat;

each of said clips has a largely downwardly projecting part for mounting on said board independently of said body, so that an upward force applied by either ones of said keys to a corresponding one of said slot upper walls can be withstood in part by a clip that lies at a corresponding one of said sides of said receptacle, with the force withstood by the clip being transmitted by the clip directly to the board.

2. The apparatus described in claim 1 wherein said plug mates with said receptacle by moving said plug in a forward longitudinal direction, and wherein said slots extend in said longitudinal direction and said body forms most of the longitudinal length of each of said slots, and including a pair of second clips that each lies at one of said opposite sides of said receptacle and with each second clip lying rearward of a corresponding one of said first clips, with each second clip forming a portion of the upper slot wall, at a corresponding one of said opposite sides of said receptacle and with each second clip having a largely downwardly projecting part for mounting on said board independently of said body.

3. The apparatus described in claim 1 wherein:

each of said first clips has a pair of largely laterally-spaced pins that are constructed to project down into a different one of a pair of holes in the board with said pins being laterally spaced from the lateral middle of the portion of the upper slot wall formed by the clip.

4. The apparatus described in claim 1 wherein:

said body forms most of the longitudinal length of each of said slots, with the upper wall of the slot having a groove and with each clip part that forms a portion of the upper slot wall lying closely in the groove.

5. Connection apparatus comprising:

a board having a plurality of contact-engaging traces and that has a plurality of holes;

a receptacle mounted on said board, said receptacle including a body of molded polymer material and a pair of first clips of metal, said receptacle having opposite sides that are spaced apart in a lateral direction and that each forms a longitudinally-extending upper slot wall that is spaced above the board;

a plug that is mateable to said receptacle, said plug having a plurality of contacts for engaging said contact-engaging traces on said circuit board, and said plug having laterally opposite plug sides with a key at each side for reception under the upper slot wall at a corresponding side of said receptacle, said keys and said upper slot walls holding down said plug contacts against said traces;

said pair of first clips each having a clip wall forming at least part of the upper slot wall at a corresponding side of said receptacle, and each clip having a first pin that projects down into one of said holes in said board with the first pin being fixed to said board thereat.

6. The apparatus described in claim 5 wherein:

said receptacle includes a pair of second clips that each has a clip wall substantially aligned with the upper wall at a corresponding side of said body with each second clip having a pin that projects down into one of said holes in said board and that is fixed to said board thereat;

the first and second clips at each side of said body being longitudinally spaced apart.

7. The apparatus described in claim 5 wherein;

each of said first clips has two pins, including said first pin and a second pin, with each post projecting down through one of said holes in said circuit board, with said pins being at least laterally spaced apart.

8. The apparatus described in claim 5 wherein:

each of said clips is formed of a copper alloy, whereby to facilitate plating and soldering.

* * * * *